US006802579B2

(12) United States Patent
Huw-Ching et al.

(10) Patent No.: US 6,802,579 B2
(45) Date of Patent: Oct. 12, 2004

(54) HANDLE ASSEMBLY HAVING LOCK MECHANISM

(75) Inventors: Fuh Huw-Ching, Taoyuan Shien (TW); Liu His An, Taoyuan Shien (TW)

(73) Assignee: Delta Electronics, Inc., Taoyuan Shien (TW)

( * ) Notice: Subject to any disclaimer, the term of this patent is extended or adjusted under 35 U.S.C. 154(b) by 0 days.

(21) Appl. No.: 10/402,296

(22) Filed: Mar. 27, 2003

(65) Prior Publication Data

US 2004/0070320 A1 Apr. 15, 2004

Related U.S. Application Data

(63) Continuation-in-part of application No. 09/755,491, filed on Jan. 4, 2001, now abandoned.

(51) Int. Cl.[7] ..... A47B 88/00

(52) U.S. Cl. ..... 312/332.1; 312/320; 312/223.1; 312/333; 312/319.1

(58) Field of Search ..... 312/223.1, 332.1, 312/333, 319.1, 348.6; 361/727; 439/64, 483

(56) References Cited

U.S. PATENT DOCUMENTS 1,476,414 A 12/1923 Ohnstrand
1,876,748 A * 9/1932 Rand, Jr. et al. ..... 312/332.1
4,155,610 A * 5/1979 Englund ..... 312/222
4,159,153 A * 6/1979 Yoshikawa ..... 312/333
4,955,678 A 9/1990 Kobayashi ..... 312/320
5,379,184 A * 1/1995 Barraza et al. ..... 361/685
5,765,933 A * 6/1998 Paul et al. ..... 312/332.1

* cited by examiner

*Primary Examiner*—Peter M. Cuomo
*Assistant Examiner*—Sarah C. Burnham
(74) *Attorney, Agent, or Firm*—Haverstock & Owens LLP

(57) ABSTRACT

A handle assembly having a lock mechanism is provided. The handle assembly includes: a handle grip member movably coupled with a casing of the appliance for receiving a first external force and a second external force, and a lock mechanism coupled with the handle grip member and mounted inside the casing, wherein the lock mechanism locks the handle grip member to the casing when the handle grip member receives the first external force, and unlocks the handle grip member when the handle grip member receives the second external force. The lock mechanism includes: a holding member having a slot thereon, a sliding member having a salient portion thereof, a first spring, and an engaging member, wherein the slot and the salient portion are engaged with each other when the handle grip member receives the first external force.

17 Claims, 8 Drawing Sheets

HANDLE ASSEMBLY HAVING LOCK MECHANISM

This application is a Continuation-In-Part of application Ser. No. 09/755,491, filed Jan. 4, 2001, now abandoned.

FIELD OF THE INVENTION

The present invention is related to a handle assembly, and more particularly, to a handle assembly having a lock mechanism.

BACKGROUND OF THE INVENTION

Nowadays, the retractable electrical equipment is a very common appliance and usually placed in a particular system frame. In order to pull out the electrical equipment easily, a handle assembly is usually designed on the panel for pulling the electrical equipment out of the system frame. However, there are some drawbacks in the conventional handle assembly coupled to an electrical equipment. Please refer to FIG. 1, which is a diagram illustrating the traditional handle assembly coupled to an appliance according to the prior art. The appliance 13 is usually a power module. The handle grip member 11 is directly fixed to the panel 12 of the appliance 13 by the screws 14. The handle grip member 11 is neither movable nor retractable, which occupies too much space of the panel 12. In addition, in order to prevent the appliance 13 from falling down from the system frame (caused by earthquake or accidentally touching by the staff), the appliance 13 has to be fixed to the system frame through more screws. In other words, the screws fixing the appliance 13 to the system frame have to be removed before pulling the appliance 13 out of the system frame, which is very inconvenient and time-wasting.

On the other hand, since the handle grip member 11 is directly fixed to the panel 12 of the appliance 13, the panel 12 will have to receive and sustain the pulling force from a user. However, the panel 12 is usually made of plastic, which is not very solid after a long-term usage. Besides, it requires the strenuous effort to pull the appliance 13 out of the system frame since the pulling force is spread to the panel 12 through the handle grip member 11. Therefore, the structure of the handle assembly is not very solid or convenient for the user.

From the above description, it is known that how to design a solid and convenient handle assembly for providing a time-saving equipment and preventing the appliance from falling down accidentally has become a major problem waited to be solved. In order to overcome the drawbacks in the prior art, a handle assembly having a lock mechanism is provided. The particular design in the present invention not only solves the problem that the handle grip member occupies too much space of the panel, but also secures structure of the handle assembly so that the appliance can be easily pulled out of the system frame. Thus, the invention has the utility for the industry.

SUMMARY OF THE INVENTION

The main purpose of the present invention is to provide a handle assembly having a lock mechanism, which allows the appliance to be easily pulled out of the system frame.

It is one object of the present invention to provide a handle assembly having a lock mechanism, which provides a bigger panel space for the user.

It is another object of the present invention to provide a handle assembly having a lock mechanism, which is able to lock the appliance on the system frame through the lock mechanism thereof so that the appliance won't be movable until the lock mechanism is unlocked.

According to one aspect of the present invention, a handle assembly for an appliance, includes: a handle grip member movably coupled with a casing of the appliance for receiving a first external force and a second external force, and a lock mechanism coupled with the handle grip member and mounted inside the casing, wherein the lock mechanism locks the handle grip member to the casing when the handle grip member receives the first external force, and unlocks the handle grip member when the handle grip member receives the second external force. The lock mechanism comprises: a holding member having a slot thereon and fixedly mounted on a side wall of the casing; a sliding member having a salient portion thereof and having one end connected with the handle grip member for sliding back and forth, wherein the slot and the salient portion are engaged with each other wren the handle grip member receives the first external force, and the slot and the salient portion are separated from each other when the handle grip member receives the second external force; a first spring connecting the sliding member and the casing for generating a first elastic force in response to the first external force and the second external force; and an engaging member having a cylinder mounted thereon and movably positioned on the side wall of the casing for engaging with the sliding member through the cylinder.

In accordance with the present invention, the sliding member has a hollow portion thereon for engaging with the cylinder mounted on the engaging member.

Preferably, the cylinder positioned on the engaging member is confined within the hollow portion of the sliding member.

Preferably, the hollow portion has a slope at the bottom thereof for the cylinder rolling along upwards when the first elastic force is generated in response to the first external force and the second external force.

Preferably, the cylinder is at a first position at one end of the slope after the handle grip member receives the first external force and is locked to the casing.

Preferably, the cylinder is at a second position at another end of the slope after the handle grip member receives the second external force and is unlocked from the casing.

Preferably, the handle assembly further comprises a second spring fixedly mounted on a side wall of the casing and connecting with the engaging member for providing a second elastic force to help the engaging member moving upwards and downwards when the second elastic force is generated in response to the first external force.

Preferably, the appliance is mounted on a supporting frame having a first aperture thereon.

Preferably, the engaging member further has a protruding portion, which can be protruded into a second aperture at the bottom of the casing and the first aperture on the supporting frame, for completely locking the handle grip member to the casing and fixing the appliance on a supporting frame when the handle grip member receives the first external force.

Preferably, the first aperture on the supporting frame has a consistent position corresponded with the second aperture on the casing so that the engaging member is able to directly protruded into the second aperture and the first aperture.

Preferably, the protruding portion will be drawn away from the first aperture when the handle grip member receives the second external force so that the handle grip member will be completely unlocked from the casing and the appliance will not be fixed on the supporting frame.

Preferably, the housing has a insertion hole for inserting and fixedly mounting the conductive terminal thereon.

Preferably, the protruding portion is protruded into the second aperture at all times so that the engaging member restrictedly moves upwards and downwards only.

Preferably, the handle grip member further comprises a blocking element at one end of the handle grip member for blocking the handle grip member from being pulled out of the appliance and sustaining a force pulling out the appliance.

Preferably, the first external force is a force pushing the handle grip member inwards to the appliance.

Preferably, the second external force is a force pushing the handle grip member downward to the appliance.

Preferably, the appliance is a retractable power module.

According to another aspect of the present invention, an appliance assembly includes: a casing of an appliance having a first aperture thereon, a supporting frame having a second aperture thereon for supporting the appliance, a handle grip member movably coupled with a casing of the appliance for receiving a first external force and a second external force, and a lock mechanism coupled with the handle grip member and mounted inside the casing, wherein the lock mechanism locks the handle grip member to the casing when the handle grip member receives the first external force, and unlocks the handle grip member when the handle grip member receives the second external force. The lock mechanism comprises: a holding member having a slot thereon and fixedly mounted on a side wall of the casing; a sliding member having a salient portion thereof and having one end connected with the handle grip member for sliding back and forth, wherein the slot and the salient portion are engaged with each other when the handle grip member receives the first external force, and the slot and the salient portion are separated from each other when the handle grip member receives the second external force; a first spring connecting the sliding member and the casing for generating a first elastic force in response to the first external force and the external second force; and an engaging member having a cylinder mounted thereon and movably positioned on the side wall of the casing for engaging with the sliding member through the cylinder.

The foregoing and other features and advantages of the present invention will be more clearly understood through the following descriptions with reference to the drawings, wherein:

DETAILED DESCRIPTION OF THE PREFERRED EMBODIMENT

Figure 2:
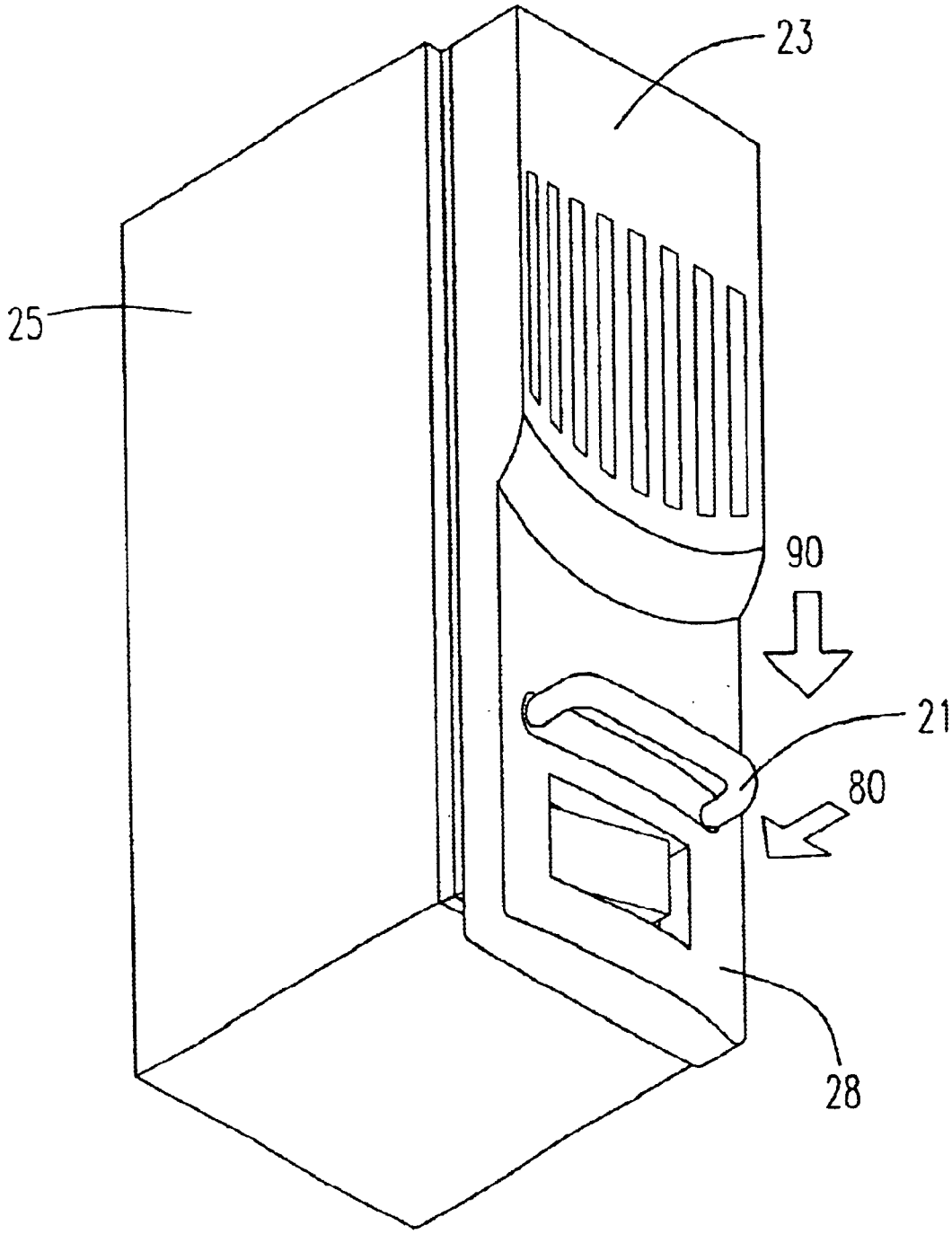
FIG. 2 is a diagram illustrating the outside appearance of the handle assembly for an appliance when the handle grip member is locked according to a preferred embodiment of the present invention.
Figure 3:
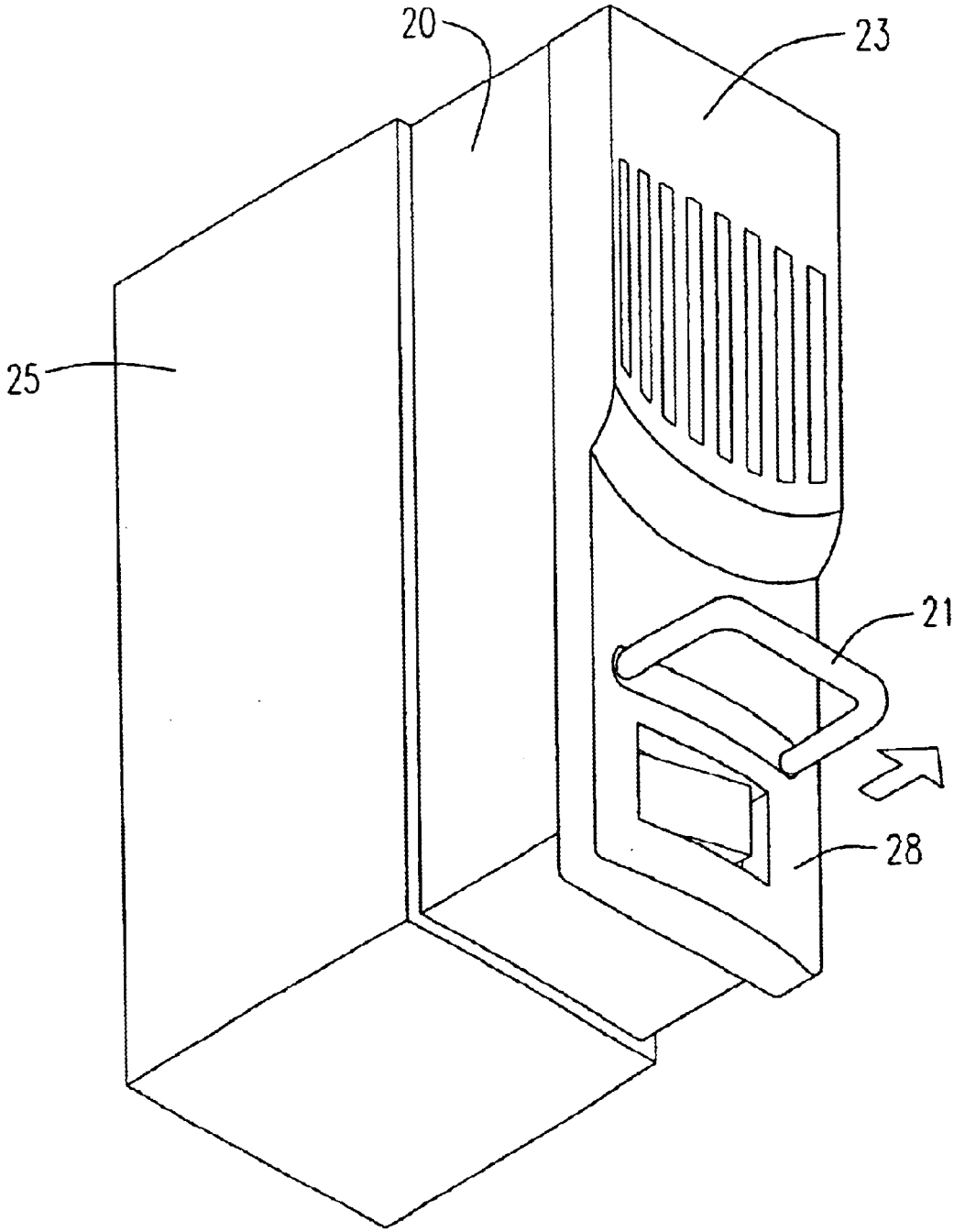
FIG. 3 is a diagram illustrating the handle assembly for an appliance when the handle grip member is unlocked according to a preferred embodiment of the present invention.

The present invention will now described more specifically with reference to the following embodiments. Please refer to FIGS. 2–3. FIG. 2 is a diagram illustrating the outside appearance of the handle assembly for an appliance when the handle grip member is locked according to a preferred embodiment of the present invention. FIG. 3 is a diagram illustrating the handle assembly for an appliance when the handle grip member is unlocked according to a preferred embodiment of the present invention. The appliance 23 is a movable equipment positioned on the system frame 25, which can be pulled out of the system frame 25 or pushed in and mounted on the system frame 25 through the handle grip member 21. The appliance 23 includes the panel 28, the casing 20 and the handle assembly 2 (shown in FIGS. 4–6). The handle grip member 21 of the handle assembly 2 is retractable. When the handle grip member 21 receives the first external force 80 pushing inwards to the appliance 23, the appliance 23 will be pushed into the system frame 25 and the handle grip member 21 will be locked as shown in FIG. 2. When the handle grip member 21 receives the second external force 90 pushing downwards, the handle grip member 21 will be unlocked and bounced out (as shown in FIG. 3) so that the user can pull the appliance 23 out of the system frame 25 easily.

Figure 1:
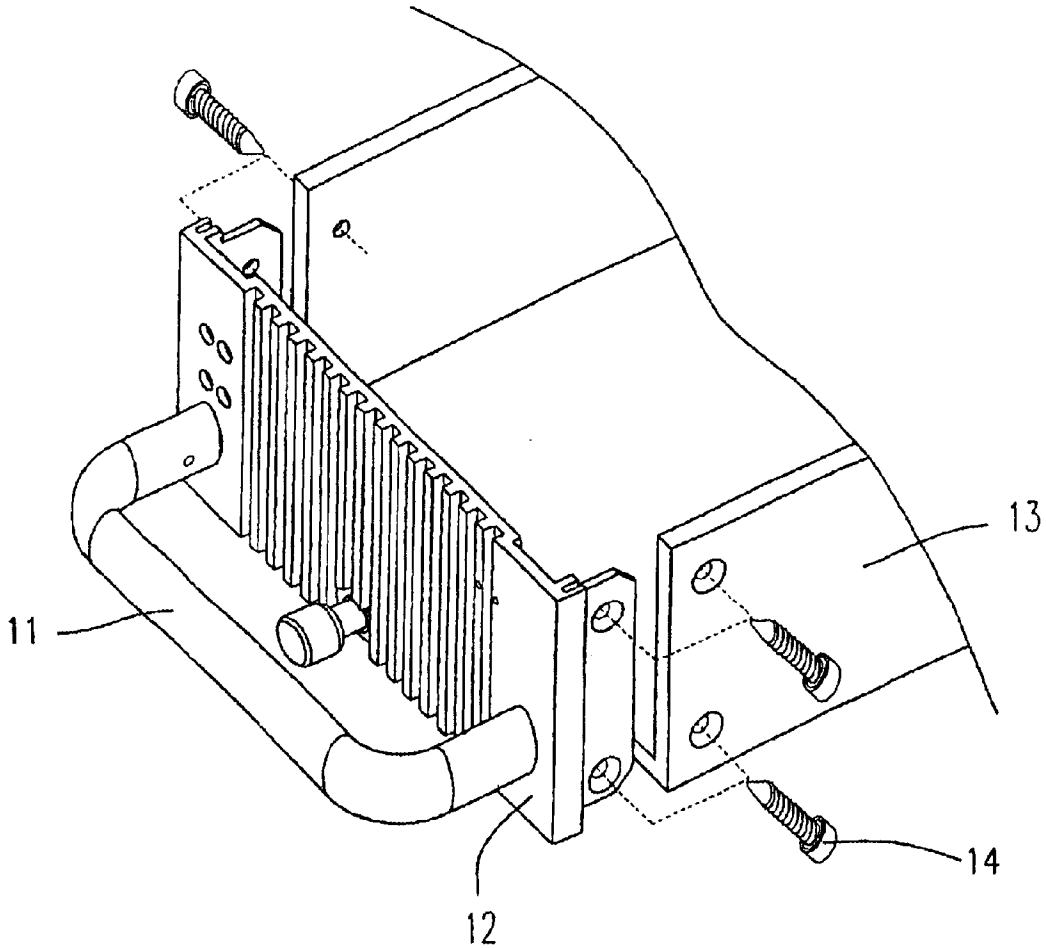
Fig. 1 (PRIOR ART)
FIG. 1 is a diagram illustrating the traditional handle assembly coupled to an appliance according to the prior art.
Figure 4:
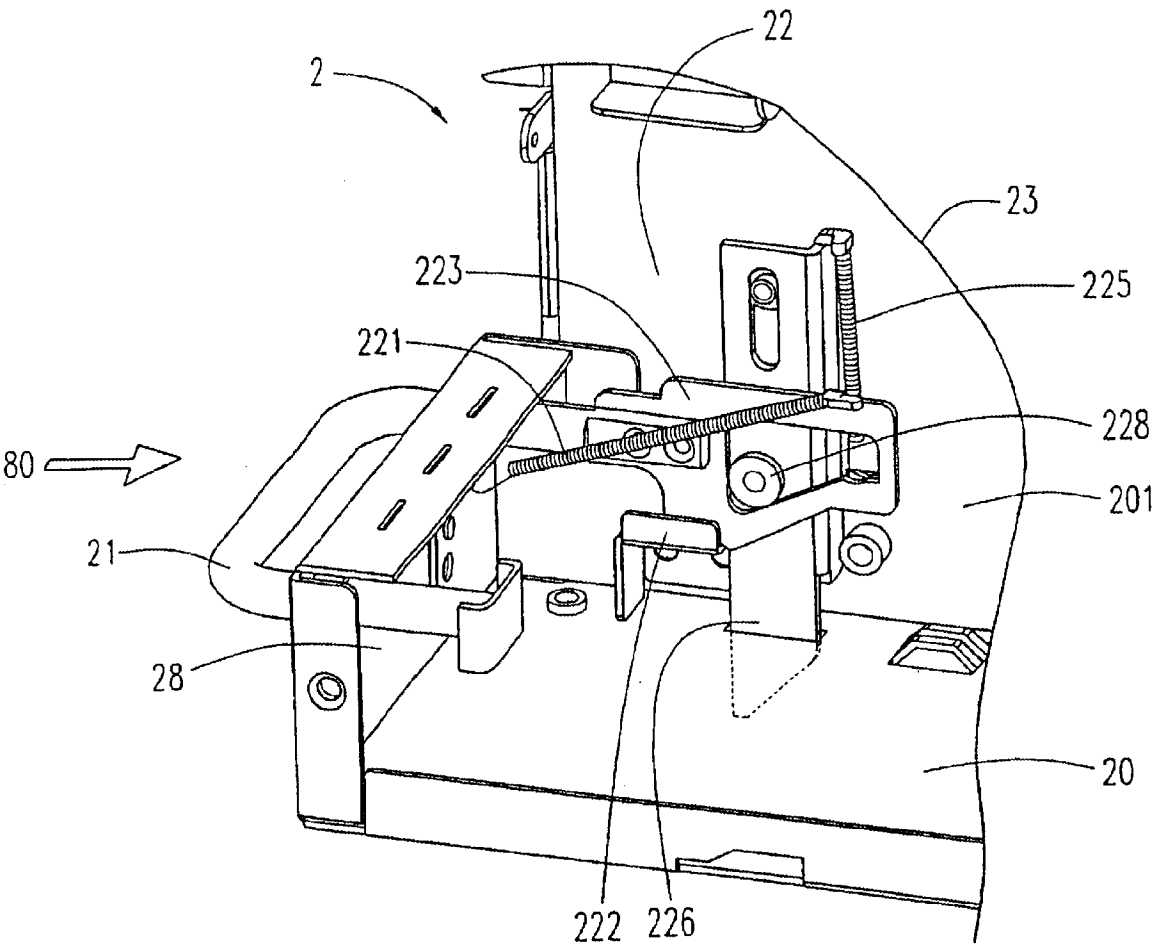
FIG. 4 is a diagram illustrating the structure of the handle assembly when the handle grip member is lock according to a preferred embodiment of the present invention.
Figure 5:
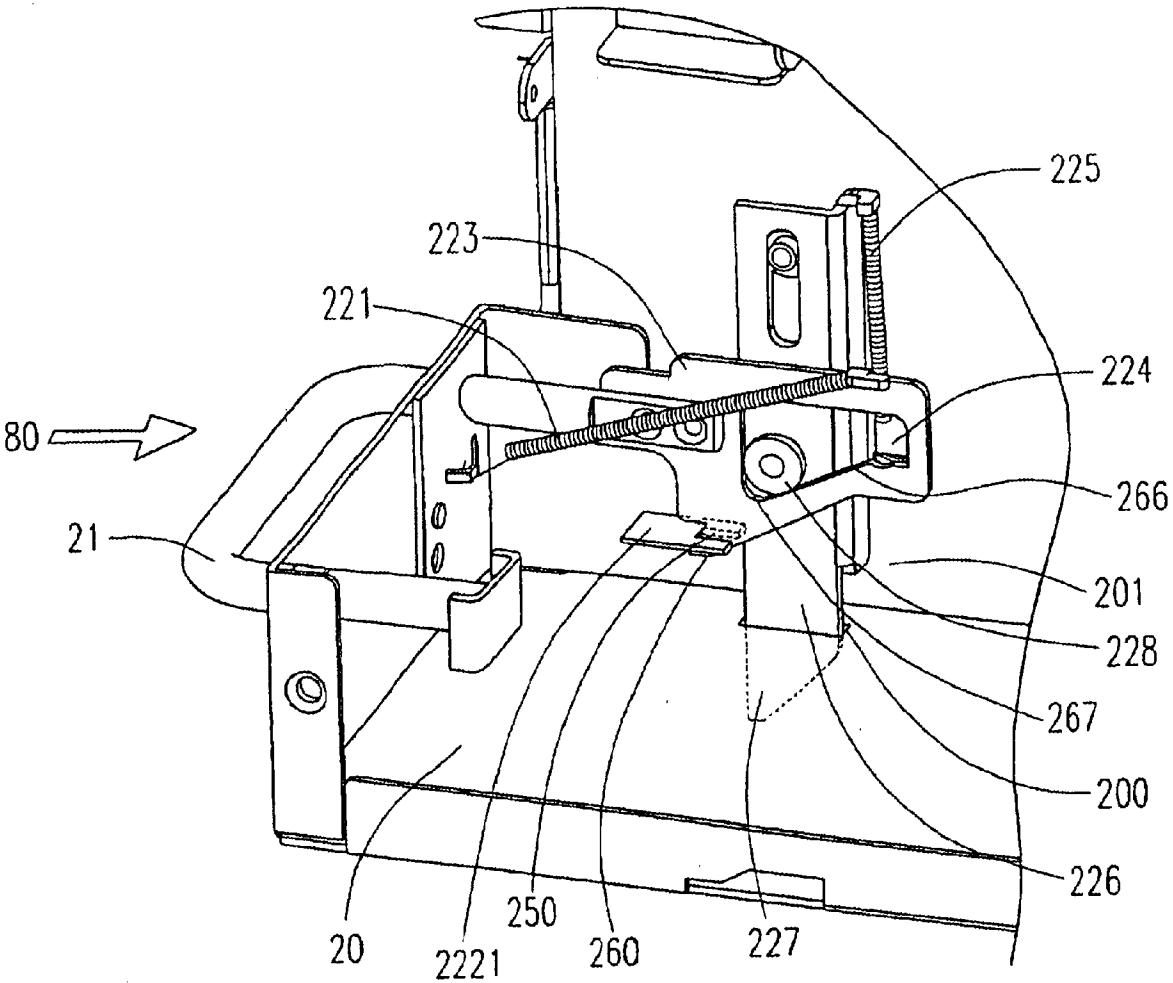
FIG. 5 is a diagram illustrating the mechanism of the handle assembly when the handle grip member is locked according to a preferred embodiment of the present invention.
Figure 6:
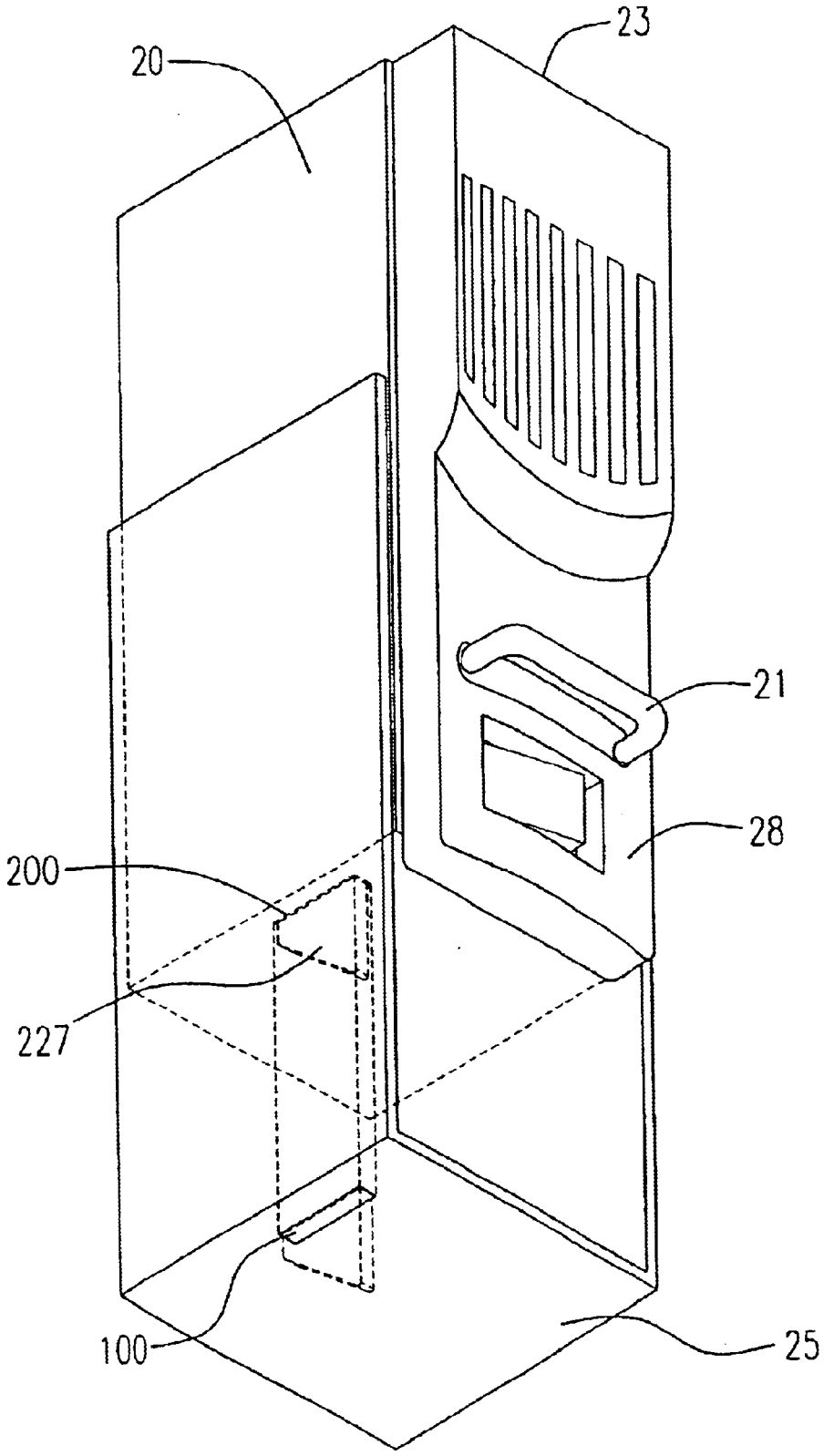
FIG. 6 is a diagram illustrating the mechanism for locking the appliance on the system frame according to a preferred embodiment of the present invention.

Please refer to FIG. 4. FIG. 4 is a diagram illustrating the structure of the handle assembly when the handle grip member is locked according to a preferred embodiment of the present invention. The handle assembly 2 includes the handle grip member 21 and the lock mechanism 22. The handle grip member 21 is movably coupled with the casing 20 of the appliance 23 for receiving the first external force 80 and the second external force 90. In other words, the handle grip member 21 is not fixed on the panel 28 as the conventional art shown in FIG. 1, but movable and retractable. The lock mechanism 22 is coupled with the handle grip member 21 and mounted inside the casing 20, which includes the holding member 222, the sliding member 223, the first spring 221, and the engaging member 226. Please refer to FIG. 5. FIG. 5 is a diagram illustrating the mechanism of the handle assembly when the handle grip member is locked according to a preferred embodiment of the present invention. The flat part 2221 of the holding member 222 is fixedly mounted on the side wall 201 of the casing 20, and has the slot 250 positioned thereon. One end of the sliding member 223 is connected with the handle grip member 21 for sliding back and forth when the handle grip member 21 receives the first and the second external forces. The sliding member 223 also has the salient portion 260 as shown in FIG. 5. When the handle grip member 21 receives the first external force 80, which pushes the sliding member 223 inwards, the slot 250 and the salient portion 260 will be engaged with each other. The first spring 221 connects the sliding member 223 and the casing 20 for generating a first elastic force in response to the first external force and the external second force. The engaging member 226 has the cylinder 228 mounted thereon. The engaging member 226 is movably positioned on the side wall 201 of the casing 20 for engaging with the sliding member 223 through the cylinder 228. Furthermore, the sliding member 223 has the hollow portion 224 for engaging with the cylinder 228. It is clearly known form FIG. 5 that the cylinder 228 positioned on the engaging member 226 is confined within the hollow portion 224 of the sliding member 223. The hollow portion 224 has the slope 266 at the bottom thereof so that the cylinder 228 can roll along upwards and downwards.

When the user pushes the handle grip member 21 inwards to the system frame 25, the first external force 80 is generated. While the handle grip member 21 receives the first external force 80, the sliding member 223 connected with the handle grip member 21 will slide inwards. Subsequently, the slot 250 of the holding member 222 and the salient portion 260 of the sliding member 223 will be engaged with each other, which tightly locks the handle grip member 21 from moving. At this time, the cylinder 228 will move to the first position 267 at one end of the slope 266 after the handle grip member 21 receives the first external force 80. Meanwhile, the first spring 221 connecting the sliding member 223 and the casing 20 is stretched and elongated, which generates a first elastic force. In addition, while the handle grip member 21 is tightly locked by the lock mechanism 22, the appliance 23 will be locked on the system frame 25 through the lock mechanism 22 too. Referring to FIG. 5, the engaging member 226 further has the protruding portion 227, which can be protruded into the second aperture 200 at the bottom of the casing 20. Please refer to FIG. 6, which is a diagram illustrating the mechanism for locking the appliance on the system frame according to a preferred embodiment of the present invention. The system frame 25 has the first aperture 100 on the plane where the appliance 23 is placed thereon. The first aperture 100 on the system frame 25 has a consistent position corresponded with the second aperture 200 on the casing 20 so that the engaging member 226 is able to directly protruded into both the second aperture 100 and the first aperture 100. In other words, when the handle grip member 21 receives the first external force 80, the cylinder 228 will move to the first position 267 at one end of the slope 266. Subsequently, the engaging member 226 will move downwards and the protruding portion 227 will be directly protruded into both the second aperture 100 and the first aperture 100, which will completely locks the appliance 23 on the system frame 25. Therefore, after handle grip member 21 receives the first external force 80 and the appliance 23 is pushed inwards to the system frame 25, not only the handle grip member 21 will be locked to the casing 20, but also the appliance 23 will be locked on the system frame 25.

Figure 7:
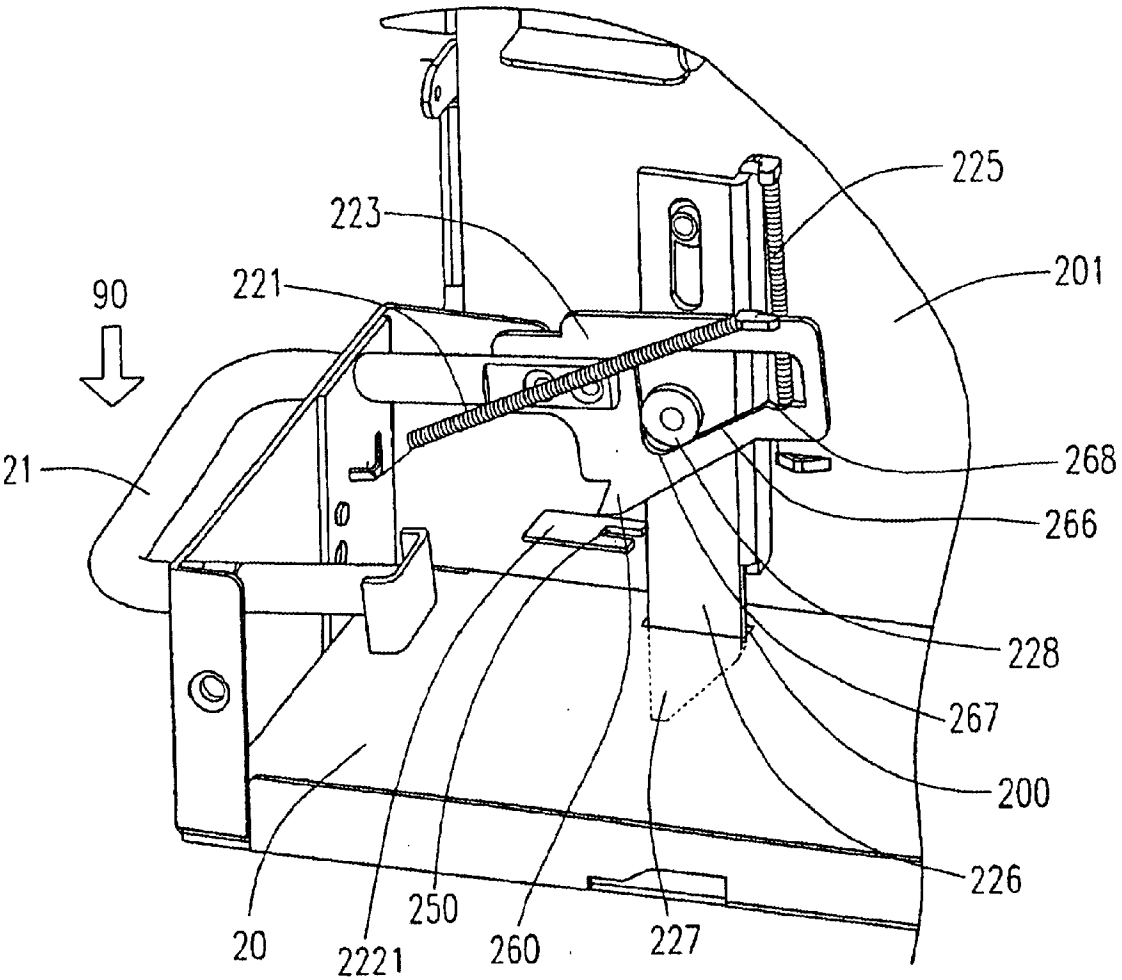
FIG. 7 is a diagram illustrating the mechanism of the handle assembly when the handle grip member is unlocked according to a preferred embodiment of the present invention.
Figure 8:
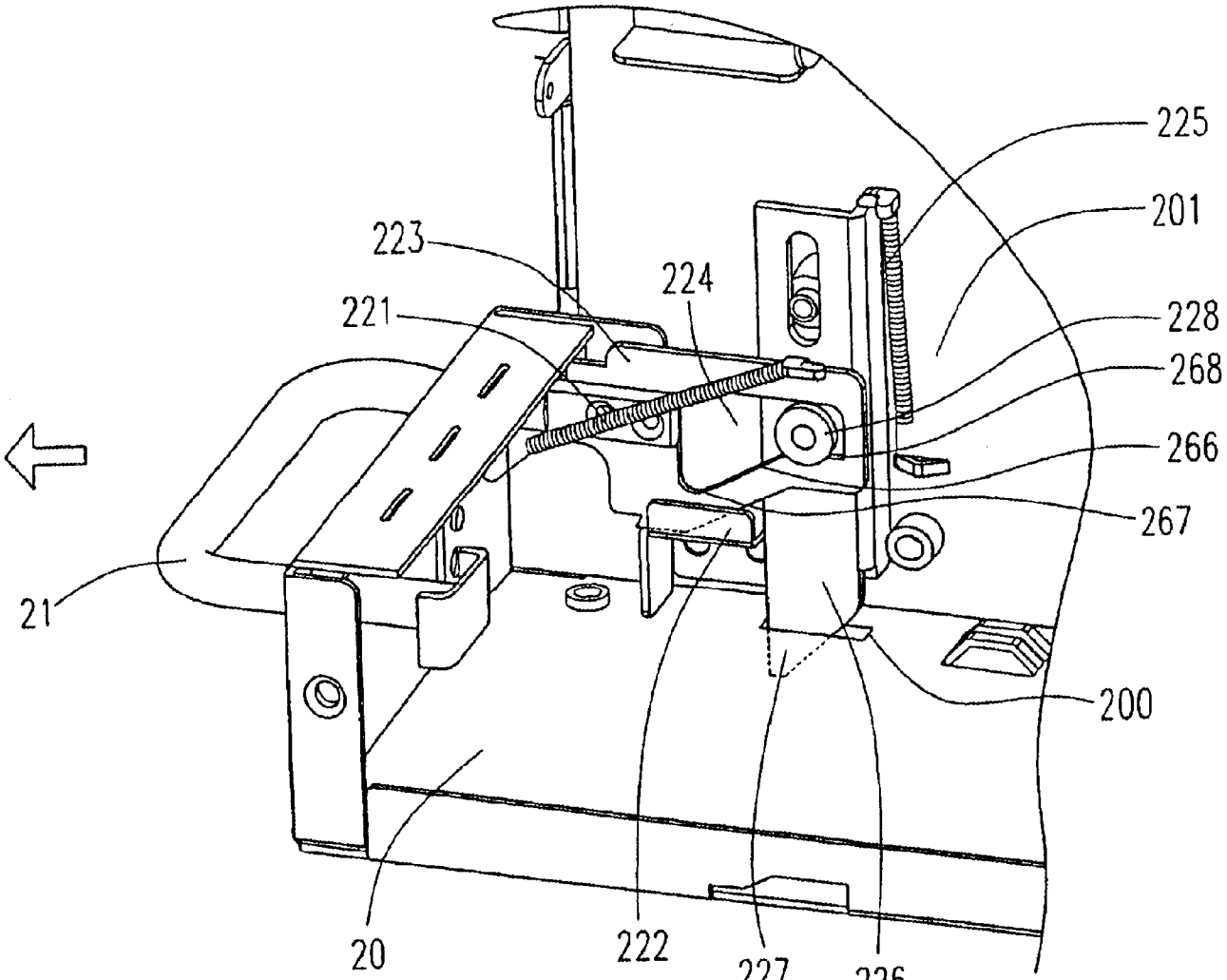
FIG. 8 is a diagram illustrating the structure of the handle assembly when the handle grip member is unlocked according to a preferred embodiment of the present invention.

Contrarily, when both the handle grip member 21 and the appliance 23 are locked, the second external force 90 pushing the handle grip member 21 downward will be able to unlock both the handle grip member 21 and the appliance 23. Please refer to FIG. 7. FIG. 7 is a diagram illustrating the mechanism of the handle assembly when the handle grip member is unlocked according to a preferred embodiment of the present invention. When the handle grip member 21 receives the second external force 90 downwards, the sliding member 223 will move upwards due to the leverage principle, as shown in FIG. 7. Meantime, the slot 250 of the holding member 222 and the salient portion 260 of the sliding member 223 will be separated from each other, which unlocks the handle grip member 21 from the casing 20. Next, the first elastic force, generated by the first spring 221 when the handle grip member 21 receives the first external force 80, will pull the sliding member 223 and make it slide towards to the direction of the handle grip member 21. At this time, following the sliding of the sliding member 223, the cylinder 228 will roll along the slope 266 upwards. Please refer to FIG. 8. FIG. 8 is a diagram illustrating the structure of the handle assembly when the handle grip member is unlocked according to a preferred embodiment of the present invention. After the handle grip member 21 receives the second external force 90, the sliding member 223 will slide towards to the direction of the handle grip member 21 due to the first elastic force. In addition, while the cylinder 228 is rolling along the slope 266 upwards, the engaging member 226 will move upwards. Therefore, the protruding portion 227 will be drawn away from the first aperture 100, which unlocks the appliance 23 from the system frame 25. However, the protruding portion 227 is not completely drawn away from the second aperture 200. Actually, the protruding portion 227 is protruded into the second aperture 200 at all times so that the engaging member 226 will restrictedly move upwards and downwards only. Also, after the sliding member 223 slides towards to the direction of the handle grip member 21 due to the first elastic force, the cylinder 228 is at the second position 268 at another end of the slope 266. Thus, after the handle grip member 21 receives the second external force 90 downwards, the handle grip member 21 will be completely unlocked from the casing 20 and the appliance 23 will not be fixed on the system frame 25. In other words, when the user pushes the handle grip member 21 downwards, both the handle grip member 21 and the appliance 23 will be unlocked and the handle grip member 21 will be bounced out, which :s very convenient for the user to pull out the appliance 23.

In addition, according to a preferred embodiment in the present invention, the handle assembly further includes the second spring 225 (shown in FIGS. 4–8) which is fixedly mounted on the side wall 201 of the casing 20 and connected with the engaging member 226. When the handle grip member 21 receives the second external force 90 and the engaging member 226 moves upwards, the second spring 225 is stretched and elongated, which generates a second elastic force. Nevertheless, the second elastic force helps the engaging member 226 move downwards when the handle grip member 21 receives the first external force 80 and the sliding member 223 slides inwards to the casing 20. In other words, the engaging member 226 moves upwards and downwards by the helping second elastic force provided by the second spring 225, which unlocks and locks the appliance 23 on the system frame 25.

Furthermore, according to a preferred embodiment in the present invention, the handle assembly further includes the blocking element 29, which is mounted at one end of the handle grip member 21 for blocking the handle grip member 21 from being pulled out of the panel 28. As shown in FIG. 8, after the handle grip member 21 receives the second external force 90, it will be bounced out by the first elastic force. However, the blocking element 29 will block the handle grip member 21 from being pulled out of the panel 28. Besides, when the user tries to pull the appliance 23 out of the system frame 25, the blocking element 29 will be stopped at the panel 28 and able to help the handle assembly to sustain the force of the user so that the structure of handle assembly won't be harmed. Preferably, the appliance 23 according to the present invention is a retractable power module.

According to the above, the drawbacks in the conventional handle assembly are not existed in the adaptor provided in the present invention. First, the handle assembly of the present invention is very useful for retracting the appliance out of a system frame. When the user pushes the handle grip member inwards to the appliance, the handle grip member is locked and the appliance is engaged with the system frame. When the user pushes the handle grip member downward, the handle grip member is unlocked and bounced out so that the appliance could be easily pulled out of the system frame. Secondly, the blocking element provides a block for sustaining the force pulling out the appliance, which provides a more complete protection for the structure of the handle assembly. Furthermore, the handle assembly provided in the present invention is integrated with the appliance. Therefore, it does not require strenuous effort for the user to pull the appliance out of the system frame. Accordingly, the handle assembly including a lock mechanism provided in the present invention could be used for preventing the appliance from falling out of the system frame due to careless collision. In addition, the provided handle grip member is connected with the casing, instead of being directly mounted on the panel as the prior art, which saves lot of space on the panel. Hence, the present invention not only has a novelty and a progressive nature, but also has an industry utility.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A handle assembly for an appliance, comprising:

a handle grip member movably coupled with a casing of said appliance for receiving a first external force and a second external force; and a lock mechanism coupled with said handle grip member and mounted inside said casing, comprising:

a holding member having a slot thereon and fixedly mounted on a side wall of said casing;

a sliding member having a salient portion thereof and having one end connected with said handle grip member for sliding back and forth, wherein said slot and said salient portion are engaged with each other when said handle grip member receives said first external force, and said slot and said salient portion are separated from each other when said handle grip member receives said second external force;

a first spring connecting said sliding member and said casing for generating a first elastic force in response to said first external force and said second external force; and an engaging member having a cylinder mounted thereon and movably positioned on said side wall of said casing for engaging with said sliding member through said cylinder, wherein said lock mechanism locks said handle grip member to said casing when said handle grip member receives said first external force, and unlocks said handle grip member when said handle grip member receives said second external force.

2. The handle assembly according to claim 1, wherein said sliding member has a hollow portion thereon for engaging with said cylinder mounted on said engaging member.

3. The handle assembly according to claim 2, wherein said cylinder positioned on said engaging member is confined within said hollow portion of said sliding member.

4. The handle assembly according to claim 2, wherein said hollow portion has a slope at the bottom thereof for said cylinder rolling along upwards when said first elastic force is generated in response to said first external force and said second external force.

5. The handle assembly according to claim 4, wherein said cylinder is at a first position at one end of said slope after said handle grip member receives said first external force and is locked to said casing.

6. The handle assembly according to claim 4, wherein said cylinder is at a second position at another end of said slope after said handle grip member receives said second external force and is unlocked from said casing.

7. The handle assembly according to claim 1 further comprising a second spring fixedly mounted on a side wall of said casing and connecting with said engaging member for providing a second elastic force to help said engaging member moving upwards and downwards when said second elastic force is generated in response to said first external force.

8. The handle assembly according to claim 1, wherein said appliance is mounted on a supporting frame having a first aperture thereon.

9. The handle assembly according to claim 8, wherein said engaging member further has a protruding portion, which can be protruded into a second aperture at the bottom of said casing and said first aperture on said supporting frame, for completely locking said handle grip member to said casing and fixing said appliance on a supporting frame when said handle grip member receives said first external force.

10. The handle assembly according to claim 9, wherein said first aperture on said supporting frame has a consistent position corresponded with said second aperture on said casing so that said engaging member is able to directly protrude into said second aperture and said first aperture.

11. The handle assembly according to claim 9, wherein said protruding portion will be drawn away from said first aperture when said handle grip member receives said second external force so that said handle grip member will be completely unlocked from said casing and said appliance will not be fixed on said supporting frame.

12. The handle assembly according to claim 9, wherein said protruding portion is protruded into said second aperture at all times so that said engaging member restrictedly moves upwards and downwards only.

13. The handle assembly according to claim 1, wherein said handle grip member further comprises a blocking element at one end of said handle grip member for blocking said handle grip member from being pulled out of said appliance and sustaining a force pulling out said appliance.

14. The handle assembly according to claim 1, wherein said first external force is a force pushing said handle grip member inwards to said appliance.

15. The handle assembly according to claim 1, wherein said second external force is a force pushing said handle grip member downward to said appliance.

16. The handle assembly according to claim 1, wherein said appliance is a retractable power module.

17. An appliance assembly, comprising:

a casing of an appliance having a first aperture thereon;

a supporting frame having a second aperture thereon for supporting said appliance;

a handle grip member movably coupled with a casing of said appliance for receiving a first external force and a second external force; and a lock mechanism coupled with said handle grip member and mounted inside said casing, comprising:

a holding member having a slot thereon and fixedly mounted on a side wall of said casing;

a sliding member having a salient portion thereof and having one end connected with said handle grip member for sliding back and forth, wherein said slot and said salient portion are engaged with each other when said handle grip member receives said first external force, and said slot and said salient portion are separated from each other when said handle grip member receives said second external force;

a first spring connecting said sliding member and said casing for generating a first elastic force in response to said first external force and said external second force; and an engaging member having a cylinder mounted thereon and movably positioned on said side wall of said casing for engaging with said sliding member through said cylinder, wherein said lock mechanism locks said handle grip member to said casing when said handle grip member receives said first external force, and unlocks said handle grip member when said handle grip member receives said second external force.

* * * * *

UNITED STATES PATENT AND TRADEMARK OFFICE

CERTIFICATE OF CORRECTION

PATENT NO. : 6,802,579 B2
DATED : October 12, 2004
INVENTOR(S) : Fuh Huw-Ching et al.

It is certified that error appears in the above-identified patent and that said Letters Patent is hereby corrected as shown below:

Column 2,
Line 19, replace “wren” with -- when --.

Column 3,
Line 62, replace “lock” with -- locked --.

Signed and Sealed this

Twenty-fifth Day of January, 2005

JON W. DUDAS
*Director of the United States Patent and Trademark Office*